US009078325B2

(12) United States Patent
Kulczycki et al.

(10) Patent No.: US 9,078,325 B2
(45) Date of Patent: Jul. 7, 2015

(54) METHOD AND APPARATUS TO CONTROL LIGHT INTENSITY AS VOLTAGE FLUCTUATES

(71) Applicant: TRW Automotive U.S. LLC, Livonia, MI (US)

(72) Inventors: Jeffrey L. Kulczycki, Plymouth, MI (US); Nicholas W. Howell, Dearborn Heights, MI (US); Stephen B. White, Minnesota City, MN (US); Gerard Zettler, Winona, MN (US); Kevin L. Medin, Lewiston, MN (US)

(73) Assignee: TRW AUTOMOTIVE U.S. LLC, Livonia, MI (US)

( * ) Notice: Subject to any disclaimer, the term of this patent is extended or adjusted under 35 U.S.C. 154(b) by 34 days.

(21) Appl. No.: 13/833,284

(22) Filed: Mar. 15, 2013

(65) Prior Publication Data

US 2014/0049177 A1 Feb. 20, 2014

Related U.S. Application Data

(60) Provisional application No. 61/684,382, filed on Aug. 17, 2012.

(51) Int. Cl.

| | |
|---|---|
| ***H05B 37/02*** | (2006.01) |
| ***H05B 39/02*** | (2006.01) |
| ***H05B 39/04*** | (2006.01) |
| ***H05B 33/08*** | (2006.01) |

(52) U.S. Cl.

CPC ..... *H05B 33/0845* (2013.01); *H05B 33/0854* (2013.01)

(58) Field of Classification Search

CPC ..... H05B 37/02; H05B 39/02; H05B 39/04; H05B 41/36

USPC ..... 315/209 R

See application file for complete search history.

(56) References Cited

U.S. PATENT DOCUMENTS

| | | | | |
|---|---|---|---|---|
| 4,156,166 | A | 5/1979 | Shapiro et al. | |
| 5,994,844 | A | 11/1999 | Crawford et al. | |
| 6,285,139 | B1 | 9/2001 | Ghanem | |
| 8,174,197 | B2 | 5/2012 | Ghanem et al. | |
| 8,508,142 | B2 * | 8/2013 | Lin et al. | 315/209 R |
| 2003/0168990 | A1 * | 9/2003 | Schenk et al. | 315/82 |
| 2005/0068459 | A1 | 3/2005 | Holmes et al. | |
| 2008/0048587 | A1 | 2/2008 | Joos et al. | |
| 2011/0187517 | A1 * | 8/2011 | Roths | 340/432 |

FOREIGN PATENT DOCUMENTS

| | | | |
|---|---|---|---|
| JP | 2007103232 | A | 4/2007 |
| JP | 2010278068 | A | 12/2010 |
| KR | 1020120044652 | A | 5/2012 |

OTHER PUBLICATIONS

International Search Report and Written Opinion, Application No. PCT/US2013/050187 dated Oct. 21, 2013.

* cited by examiner

*Primary Examiner* — Anh Tran

(74) *Attorney, Agent, or Firm* — MacMillan, Sobanski & Todd, LLC

(57) ABSTRACT

A method and apparatus for generating a pulse width modulated voltage that has a duty cycle that is inversely proportional to a sensed battery voltage and using the generated pulse width modulated voltage to control a light emitting diode to maintain the intensity of light emitted as the battery voltage fluctuates.

8 Claims, 4 Drawing Sheets

| Voltage | DUTY CYCLE |
|---|---|
| 6 | 100 |
| 7 | 73 |
| 8 | 58 |
| 9 | 48 |
| 10 | 41 |
| 11 | 36 |
| 12 | 32 |
| 13 | 30 |
| 14 | 27 |
| 15 | 25 |
| 16 | 23 |

METHOD AND APPARATUS TO CONTROL LIGHT INTENSITY AS VOLTAGE FLUCTUATES

CROSS-REFERENCE TO RELATED APPLICATIONS

This application claims the benefit of U.S. Provisional Application No. 61/684,382, filed Aug. 17, 2012, the disclosure of which is incorporated herein by reference.

BACKGROUND OF THE INVENTION

This invention relates in general to vehicle lighting systems. In particular, this invention relates to a method and apparatus for regulating lighting voltage to maintain a relatively constant intensity of light output as an input voltage, such as a vehicle battery voltage, fluctuates during use.

In an effort to conserve energy, light emitting diodes (LEDs) are increasingly being used for vehicle lighting applications. In such applications, power is supplied to the LEDs from a vehicle electrical system, which typically includes a conventional battery. However, it is known that the output voltage of a vehicle battery may vary relatively widely during use, and such variances can have an undesirable effect upon the intensity of the light output from the LEDs. For example, many vehicle manufacturers are developing an engine start/stop mode of operation, in which the vehicle engine is shut off when the vehicle is stationary for more than a predetermined period of time for fuel economy. Upon subsequent cranking the engine for restart, the battery voltage typically experiences a dip, which may undesirably lessen the intensity of light emitted from the vehicle LEDs.

The adverse effects of variations in the battery voltage may be ameliorated by use of a voltage regulating circuit. However, with the increasing number of LEDs being used in vehicles, the current demand upon such a voltage regulating circuit may become excessive, which may lead to overheating and failure. Alternately, an AC/DC switching regulator circuit or a DC/DC regulator circuit may be utilized. However, such circuits are relatively complex and expensive. Therefore, an inexpensive method for regulating the voltage applied to vehicle LEDs as vehicle battery voltage fluctuates would be desirable.

SUMMARY OF THE INVENTION

This invention relates to a method and apparatus for regulation of the lighting voltage to maintain the intensity of the light output relatively constant as the output voltage from a source, such as a vehicle battery, fluctuates during use. The apparatus includes a controller having an input port that is adapted to be connected to a vehicle battery and an output port. The controller is operable to generate a pulse width modulated voltage having a duty cycle that is inversely proportional to the battery voltage applied to the input port. The apparatus also includes at least one electronic switch having a control terminal that is connected to the controller output port. The electronic switch has a first terminal and a second terminal, the second terminal being connected to ground. The apparatus further includes at least one light emitting diode having a first terminal connected to the first terminal of the electronic switch and a second terminal adapted to be connected to the vehicle battery.

The method for controlling the light emitting diode includes the steps of sampling a battery voltage and selecting a duty cycle that is inversely proportional to the sampled battery voltage. The method also includes generating a pulse width modulated voltage having the selected duty cycle and applying the generated pulse width modulated voltage to an electronic switch that is operative to control a light emitting diode.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
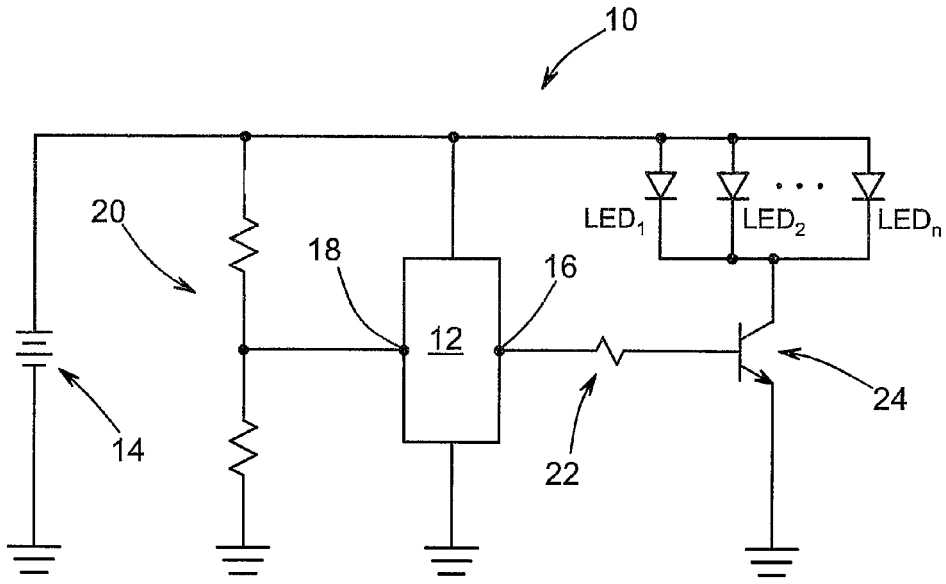
FIG. 1 is a schematic circuit diagram of an apparatus in accordance with this invention.

Referring now to the drawings, there is illustrated in FIG. 1 a schematic circuit diagram of an apparatus 10 in accordance with this invention. The apparatus 10 includes a light emitting diode (LED) controller 12 that is connected between electrical ground potential and a source of electrical energy, such as a vehicle battery 14. The controller 12 may include a pulse width modulator, a timer oscillator, a microcontroller, a microprocessor, an oscillator circuit, or other devices (not shown) as is well known in the art. The LED controller 12 may also be included within another vehicle system controller (not shown). The LED controller 12 is operative to generate a pulse width modulated (PWM) voltage at an output port 16 that has a duty cycle that is inversely proportional to a voltage applied to an input port 18. The controller input port 18 is connected to a center tap of a resistive voltage divider 20 that is connected between a positive terminal of the battery 14 and ground potential. Thus, the magnitude of the voltage that is applied to the controller input port 18 is defined by the resistive voltage divider 20 and is directly proportional to the magnitude of the output voltage of the battery 18.

The LED controller output port 16 is connected through a resistor 22 to a base of a switching transistor 24. Although the illustrated switching transistor 24 is a conventional NPN transistor, it will be appreciated that other switching devices such as, for example, a PNP transistor, a FET, or any other switching device (not shown) may alternatively be used. The switching transistor 24 has an emitter that is connected to ground potential and a collector that is connected to a cathode of one or more LEDs, such as shown as $LED_1$ through $LED_n$. Although only one switching transistor 24 is shown in FIG. 1, it will be appreciated that a plurality of such switching transistors 24 may be connected to the LED controller output port 16 if necessary or desired. The anodes of the LEDs are connected to the positive terminal of the vehicle battery 14.

Figure 2:
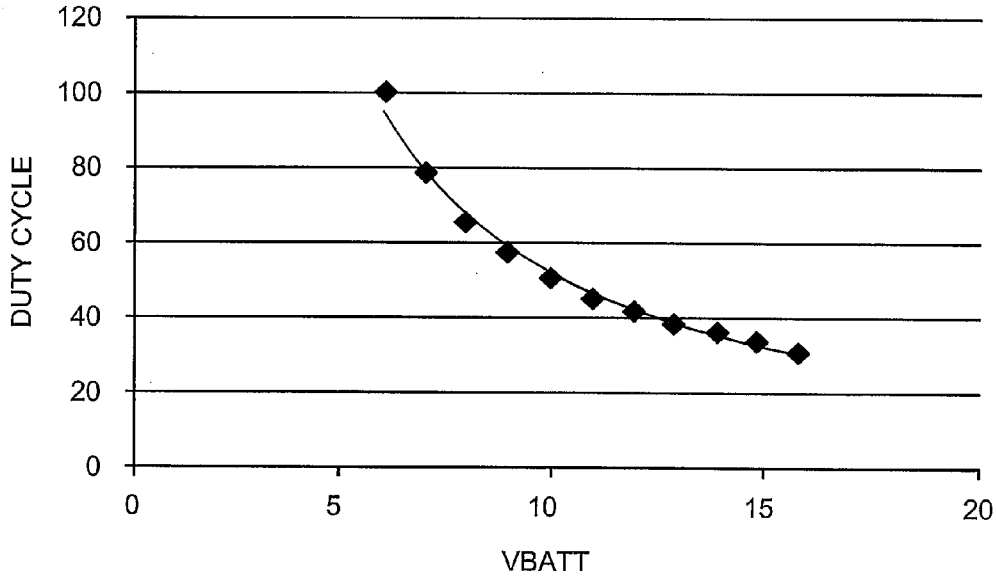
FIG. 2 is a graph showing a first mode of operation of the apparatus illustrated in FIG. 1.

FIG. 2 is a graph showing the operation of the apparatus illustrated in FIG. 1, specifically, the relationship between the magnitude of the battery voltage (as defined by the magnitude of the voltage present at the center tap of a resistive voltage divider 20) and the output PWM voltage duty cycle generated by the LED controller 12. In the illustrated embodiment, this relationship is non-linear. However, a linear relationship may be used if desired. It will be appreciated that the shape of the curve may vary in accordance with a variety of factors (such as the types of the LEDs being used), and different curves can be developed for each different LEDs and/or applications.

For example, as shown in FIG. 2, the output PWM voltage duty cycle generated by the LED controller 12 is initially selected to be 100% when the magnitude of the battery voltage is about six volts. As the magnitude of the battery voltage increases from about six volts to about sixteen volts, the output PWM voltage duty cycle generated by the LED controller 12 decreases from 100% to about 35% in a non-linear manner. This invention contemplates that the output PWM voltage duty cycle generated by the LED controller 12 can either (1) begin decreasing at a magnitude of the battery voltage that is either greater than or less than six volts, (2) stop decreasing at a magnitude of the battery voltage that is either greater than or less than sixteen volts, (3) decrease in a different non-linear manner than as illustrated, or (4) decrease in a linear manner.

Figure 6:
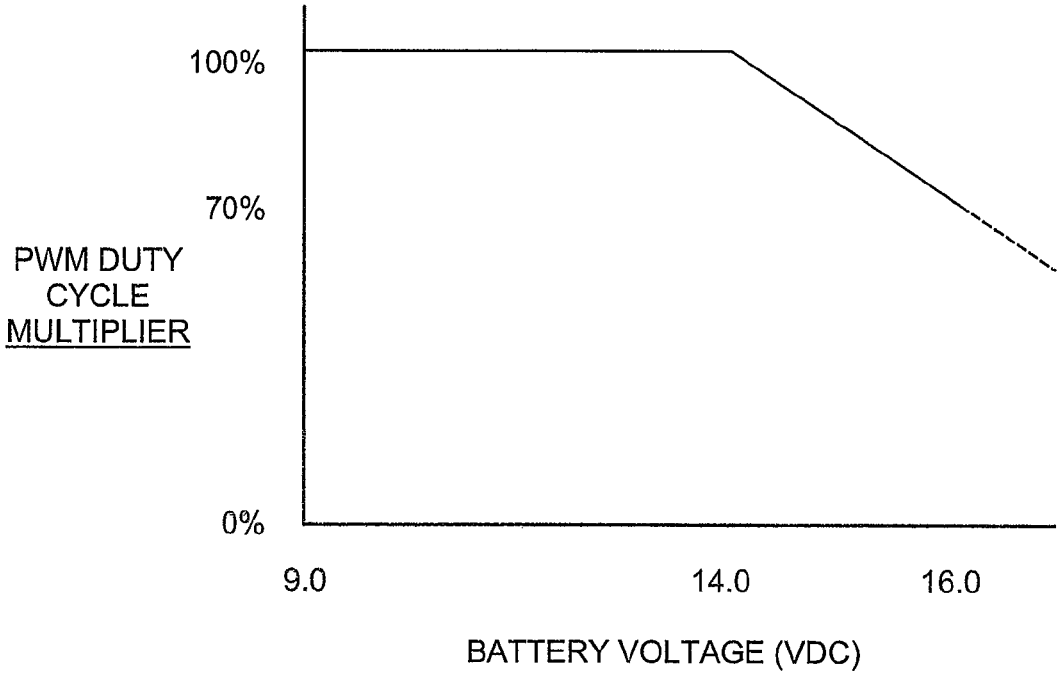
FIG. 6 is a graph showing a second mode of operation of the apparatus illustrated in FIG. 1.

Alternatively, as shown in FIG. 6, the output PWM voltage duty cycle generated by the LED controller 12 can be initially selected to be 100% when the magnitude of the battery voltage is less than a threshold amount, such as about fourteen volts. As the magnitude of the battery voltage increases above this threshold amount, the output PWM voltage duty cycle generated by the LED controller 12 decreases from 100% in a linear manner. As above, this invention contemplates that the output PWM voltage duty cycle generated by the LED controller 12 can either (1) begin decreasing at a magnitude of the battery voltage that is either greater than or less than fourteen volts, (2) decrease in a different linear manner than as illustrated, or (3) decrease in a non-linear manner.

Figures 3, 4:
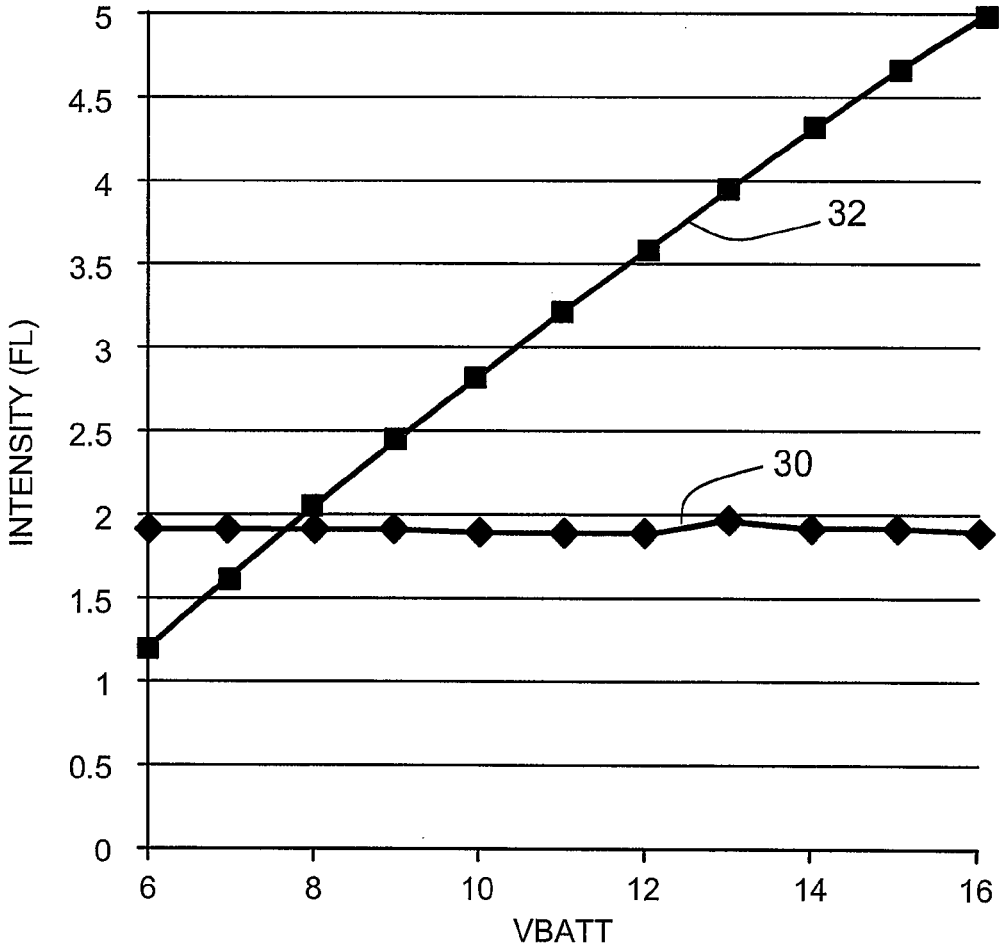
FIG. 3 is a table of values for points shown on the graph illustrated in FIG. 2.
FIG. 4 is another graph that compares the operation of the apparatus illustrated in FIG. 1 with a prior art apparatus.

The LED controller 12 may utilize any desired method to determine the output PWM voltage duty cycle based upon the magnitude of the battery voltage. One such method is a look-up table, such as shown in FIG. 3. Using this look-up table, the LED controller 12 can be responsive to the magnitude of the battery voltage (as defined by the magnitude of the voltage present at the center tap of a resistive voltage divider 20 and at the input port of the LED controller 12) for selecting a desired one of a plurality of values in the table for the output PWM voltage duty cycle to be generated from the output port of the LED controller 12 through the resistor 22 to the base of the switching transistor 24. If desired, the LED controller 12 may be provided with the capability to interpolate between the discrete values shown in the table.

Alternately, the magnitude of the battery voltage may be related by a mathematical function to the sensed battery voltage. For example, a power series may be utilized, such as:

duty cycle=K1*(sensed battery voltage)$^{-K2}$, where

K1 is a first constant, and

K2 is a second constant, wherein the first and second constants are selected to provide a desired shape to the curve shown in FIG. 2. Other power series and mathematical relationships also may be utilized. In the preferred embodiment, the output PWM voltage duty cycle varies within a range of approximately 20% to 100%, although the invention also may be practiced with either a lower or higher minimum or maximum values for the duty cycle range.

The output PWM voltage duty cycle has a frequency that is preferably set by the LED controller 12 to avoid flickering of the LEDs or other visible lighting changes. In the preferred embodiment, the frequency is one kHz or more, although other desired frequencies also may be used. Additionally, the sampling rate for the battery voltage can be selected based upon the possible battery voltage transient timing. With regard to sampling of the battery voltage, in the preferred embodiment, the battery voltage is sampled with a time period between samples selected from within the range 0.1 to 10.0 milliseconds, although other sampling times may be utilized. Again, the criterion for selecting the sampling rate is to preferably avoid flickering of the LEDs or other visible lighting changes.

The operation of this invention is shown in FIG. 4, which illustrates an intensity of an LED as a function of the vehicle battery voltage. The flat, generally horizontal line labeled 30 shows the result of using the apparatus 10 shown in FIG. 1, while the sloped line labeled 32 shows the result of connecting the LED directly to the battery. It is apparent that the apparatus 10 provides a far better performance with regard to battery output fluctuations without needing to resort to expensive regulator circuitry.

Figure 5:
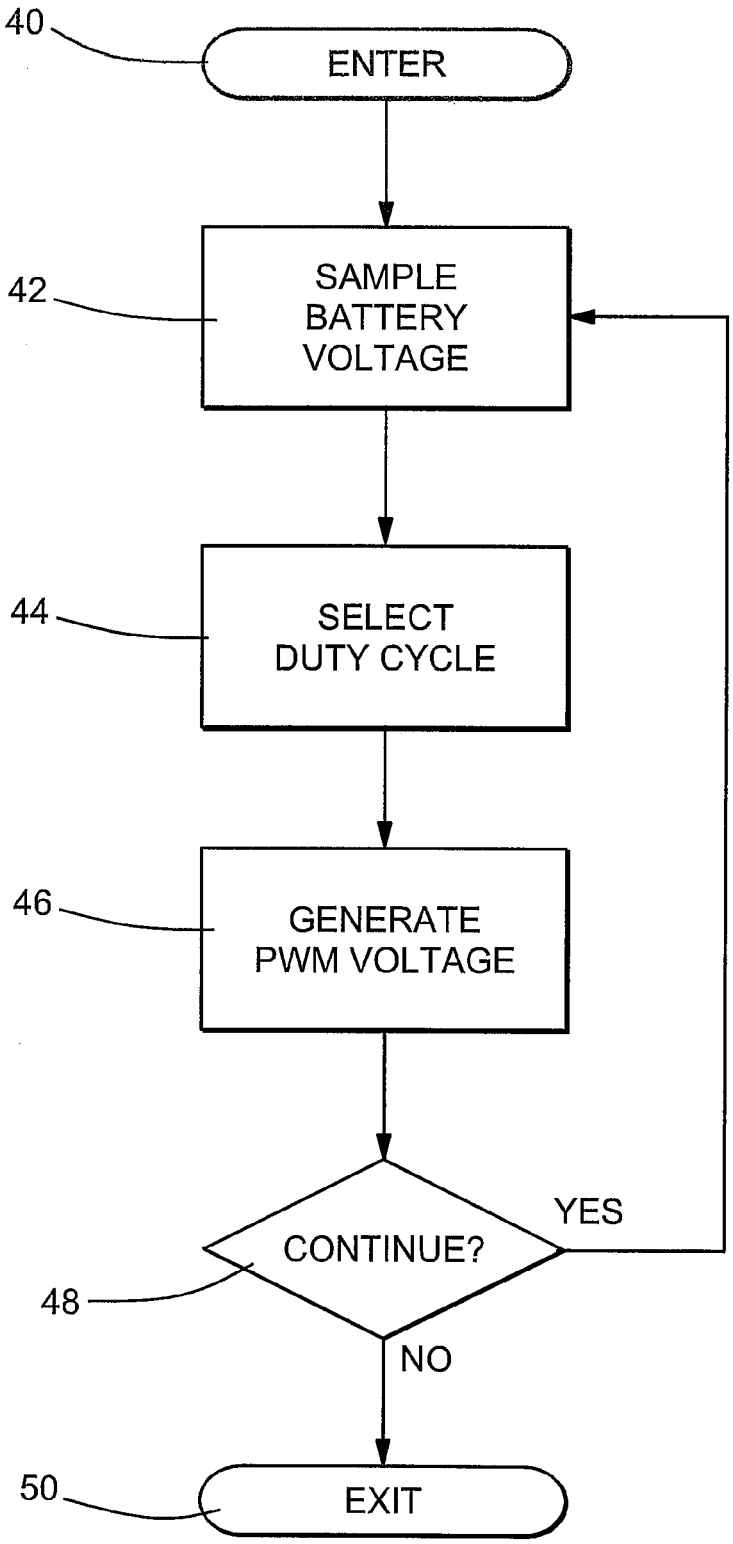
FIG. 5 is a flow chart of an algorithm in accordance with this invention.

This invention also contemplates a method for operating LEDs that is illustrated by the flowchart shown in FIG. 5. The flow chart is entered through a block 40 and proceeds to a functional block 42, where the vehicle battery voltage is sampled or otherwise sensed. The method then continues to a functional block 44, where a duty cycle is selected that corresponds to the sensed battery voltage. The method continues further to a functional block 46, where an output PWM voltage having the duty cycle selected in block 44 is generated and applied to the electronic switch 24 of the apparatus 10. The method then advances to a decision block 48, where it is decided whether or not to continue. Any number of criteria may be used in the decision block 48 such as, for example, whether the LEDs are on or whether the vehicle ignition on. If the decision made in the decision block 48 is to continue, the method returns to functional block 42 and begins another iteration of the method. If, on the other hand, the decision in the decision block 48 is to not continue, the method transfers to a block 50 and exits.

During operation, this invention is capable of maintaining the intensity of the light emitted from the LEDs at almost a constant level over a battery voltage variation of six volts to sixteen volts without exceeding the corresponding maximum LED current. This also holds true when the LEDs are intentionally dimmed. It will be appreciated that this invention also may be practiced for other ranges of battery voltage variation that are either greater than sixteen volts or less than six volts. Additionally, with regard to colored LEDs, it has been found that, depending upon the specific LED and color utilized, any color shift as the output PWM voltage duty cycle is changed may be minimal.

It is also contemplated that this invention may be used to provide dimming levels of backlighting, such as needed for instrument panel illumination. The dimming would be achieved by applying a mathematical function to each of the table values or duty cycle values. For example, dimming may be achieved by multiplying each table value or duty cycle value by some dimming factor, which may be either a constant or a variable. This is an advantage because it reduces the amount of table values required when all the dimming levels required by vehicle manufacturers are considered and, thus, reduces the amount of memory required to store all the table values.

Although the invention has been described and illustrated as being applied to LEDs, it will be appreciated that the invention also may be practiced with other light sources, such as, for example, incandescent light bulbs and halogen lamps. Additionally, the circuits and graphs presented in the figures are meant to be exemplary, and the invention also may be practiced with other circuit configurations and relationships. In a like manner, the method illustrated by the flow chart in FIG. 5 also is meant to be exemplary, and the invention also may be practiced with algorithms having flowcharts that differ from that shown in FIG. 5.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus comprising:

a source that generates an electrical voltage having a magnitude;

an electric light that is connected to the source of voltage;

a switch that is connected between the electric light and ground potential and is responsive to a pulse width modulated signal having a duty cycle for selectively connecting the electric light to ground potential; and a controller that generates a pulse width modulated signal having a duty cycle to the switch in such a manner as to maintain an intensity of light emitted from the electric light relatively constant regardless of variations in the magnitude of the electrical voltage generated from the source by either:

(1) decreasing the duty cycle of the pulse width modulated signal whenever the voltage generated by the source of electrical energy increases; or (2) maintaining the duty cycle of the pulse width modulated signal constant whenever the voltage generated by the source of electrical energy is less than a threshold value, then decreasing the duty cycle of the pulse width modulated signal either linearly or non-linearly whenever the voltage generated by the source of electrical energy increases past the threshold value.

2. The apparatus defined in claim 1 wherein the controller decreases the duty cycle of the pulse width modulated signal whenever the voltage generated by the source of electrical energy increases.

3. The apparatus defined in claim 1 wherein the controller decreases the duty cycle of the pulse width modulated signal linearly whenever the voltage generated by the source of electrical energy increases.

4. The apparatus defined in claim 1 wherein the controller decreases the duty cycle of the pulse width modulated signal non-linearly whenever the voltage generated by the source of electrical energy increases.

5. The apparatus defined in claim 1 wherein the controller maintains the duty cycle of the pulse width modulated signal constant whenever the voltage generated by the source of electrical energy is less than a threshold value, then decreases the duty cycle of the pulse width modulated signal either linearly or non-linearly whenever the voltage generated by the source of electrical energy increases past the threshold value.

6. The apparatus defined in claim 1 wherein the controller maintains the duty cycle of the pulse width modulated signal constant whenever the voltage generated by the source of electrical energy is less than a threshold value, then decreases the duty cycle of the pulse width modulated signal linearly whenever the voltage generated by the source of electrical energy increases past the threshold value.

7. The apparatus defined in claim 1 wherein the controller maintains the duty cycle of the pulse width modulated signal constant whenever the voltage generated by the source of electrical energy is less than a threshold value, then decreases the duty cycle of the pulse width modulated signal non-linearly whenever the voltage generated by the source of electrical energy increases past the threshold value.

8. The apparatus defined in claim 1 wherein plural electric lights are connected to the source of voltage, and wherein the switch is connected between each of the plural electric lights and ground potential.

* * * * *